US010283259B2

(12) United States Patent
Kainaga et al.

(10) Patent No.: US 10,283,259 B2
(45) Date of Patent: May 7, 2019

(54) STATIONARY INDUCTION APPARATUS

(71) Applicant: Mitsubishi Electric Corporation, Chiyoda-ku (JP)

(72) Inventors: Soichiro Kainaga, Chiyoda-ku (JP); Takahiro Umemoto, Chiyoda-ku (JP); Takao Tsurimoto, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/549,455

(22) PCT Filed: Feb. 17, 2016

(86) PCT No.: PCT/JP2016/054521
§ 371 (c)(1),
(2) Date: Aug. 8, 2017

(87) PCT Pub. No.: WO2016/152328
PCT Pub. Date: Sep. 29, 2016

(65) Prior Publication Data

US 2018/0025833 A1 Jan. 25, 2018

(30) Foreign Application Priority Data

Mar. 24, 2015 (JP) ..... 2015-060702

(51) Int. Cl.
*H01F 27/28* (2006.01)
*H01F 27/34* (2006.01)

(52) U.S. Cl.
CPC ..... *H01F 27/343* (2013.01); *H01F 27/2885* (2013.01)

(58) Field of Classification Search
CPC .... H01F 27/343; H01F 27/2885; H01F 27/36; H01F 27/362; H01F 27/288; H01F 2017/008; H01F 27/346; H01F 27/365
(Continued)

(56) References Cited

U.S. PATENT DOCUMENTS 2,318,068 A * 5/1943 Elsner ..... H01F 27/343 336/184
3,376,530 A * 4/1968 Fischer ..... H01F 27/2885 336/70

(Continued)

FOREIGN PATENT DOCUMENTS

JP 51-67316 U 11/1974
JP 55-68325 U 11/1978

(Continued)

OTHER PUBLICATIONS

International Search Report dated May 10, 2016, in PCT/JP2016/054521, filed Feb. 17, 2016.

(Continued)

*Primary Examiner* — Mang Tin Bik Lian
(74) *Attorney, Agent, or Firm* — Oblon, McClelland, Maier & Neustadt LLP

(57) ABSTRACT

A plurality of windings each including an electric wire portion and a first insulating coating that coats the electric wire portion. A plurality of electrostatic shields each including a conductor and a second insulating coating that coats the conductor. A stationary induction apparatus satisfies at least one positional relationship among: a relationship in which an outer peripheral end of the conductor in each of the electrostatic shields is located inside an outer peripheral end of the electric wire portion of an adjacent winding among the windings, the adjacent winding being adjacent to the electrostatic shield in the direction extending along the central axis; and a relationship in which an inner peripheral end of the conductor in each of the electrostatic shields is located outside an inner peripheral end of the electric wire portion of the adjacent winding.

10 Claims, 10 Drawing Sheets

(58) Field of Classification Search
USPC ..... 336/84 C, 177, 221
See application file for complete search history.

(56) References Cited

U.S. PATENT DOCUMENTS

| | | | | | |
|---|---|---|---|---|---|
| 3,983,522 | A * | 9/1976 | Gearhart | H01F 27/345 | 336/70 |
| 4,042,900 | A * | 8/1977 | Hinton | H01F 27/345 | 336/187 |
| 4,317,096 | A * | 2/1982 | Degeneff | H01F 27/006 | 336/70 |
| 2010/0007452 | A1* | 1/2010 | Forsberg | H01F 27/2885 | 336/90 |
| 2013/0113598 | A1* | 5/2013 | Murillo | H01F 27/2885 | 336/84 C |
| 2013/0207767 | A1* | 8/2013 | Worthington | H01F 27/2804 | 336/84 C |

FOREIGN PATENT DOCUMENTS

| | | | |
|---|---|---|---|
| JP | 57-80818 | U | 5/1982 |
| JP | 60-81623 | U | 6/1985 |
| JP | 60-121710 | A | 6/1985 |
| JP | 60-113614 | U | 8/1985 |
| JP | 60-247911 | A | 12/1985 |
| JP | 6-31130 | U | 4/1994 |
| JP | 6-62518 | U | 9/1994 |
| JP | 7-201607 | A | 8/1995 |
| JP | 11-026259 | A * | 1/1999 |
| JP | 11-26259 | A | 1/1999 |

OTHER PUBLICATIONS

Office Action dated Sep. 20, 2016 in Japanese Patent Application No. 2016-548400 (with English Translation).

* cited by examiner

STATIONARY INDUCTION APPARATUS

TECHNICAL FIELD

The present invention relates to stationary induction apparatuses, and particularly, to a stationary induction apparatus including electrostatic shields.

BACKGROUND ART

When an impulse voltage such as lightning surge enters a stationary induction apparatus such as a transformer or reactor, the potential distribution in a winding becomes steep compared with the potential distribution that corresponds to the number of turns, and then, oscillations occur around the potential distribution corresponding to the number of turns. This phenomenon is referred to as potential oscillations. If potential oscillations have a large amplitude, a dielectric breakdown may occur due to a large potential difference generated between adjacent electric wires in a winding and between adjacent windings. When electrostatic shields are installed adjacent to windings, the electrostatic capacity between the windings becomes larger than the electrostatic capacity between the winding and the ground, thus reducing the amplitude of potential oscillations.

Japanese Utility Model Laying-Open No. 60-113614 (Patent Document 1) is a prior art document that discloses a transformer including electrostatic shields. In the transformer described in Patent Document 1, the electrostatic shields are provided at opposite ends of the winding in their central axes. Each of the outer peripheral ends and inner peripheral ends of the electrostatic shields is formed as a curved surface. The electrostatic shield is fixedly fastened to the winding in the central axis direction of the winding and has a width substantially identical to the width of the winding in the radial direction.

CITATION LIST

Patent Document

PTD 1: Japanese Utility Model Laying-Open No. 60-113614

SUMMARY OF INVENTION

Technical Problem

In the electrostatic shields of the transformer described in Patent Document 1, an electric field is concentrated on some spots of the outer peripheral end and the inner peripheral end opposite to their adjacent coils. When the respective curvature radii of the outer peripheral ends and inner peripheral ends of the electrostatic shields are increased to reduce electric field concentration on the outer peripheral ends and inner peripheral ends of the electrostatic shields, the electrostatic shields become thicker, increasing the size of a stationary induction apparatus. The present invention has been made to solve the problem above, and has an object to provide a stationary induction apparatus that can reduce electric field concentration at at least any one of the outer peripheral end and inner peripheral end of an electrostatic shield while restraining the electrostatic shield from thickening.

Solution to Problem

A stationary induction apparatus according to the present invention includes a core, a plurality of windings wound around the core that is a central axis, and a plurality of annular electrostatic shields disposed adjacent to respective ends of the plurality of windings in a direction extending along the central axis. Each of the plurality of windings includes an electric wire portion and a first insulating coating that coats the electric wire portion. Each of the plurality of electrostatic shields includes a conductor and a second insulating coating that coats the conductor. The stationary induction apparatus satisfies at least one positional relationship among: a positional relationship in which an outer peripheral end of the conductor in each of the plurality of electrostatic shields is located inside an outer peripheral end of the electric wire portion of an adjacent winding among the plurality of windings in a radial direction of the central axis, the adjacent winding being adjacent to the electrostatic shield in the direction extending along the central axis; and a positional relationship in which an inner peripheral end of the conductor in each of the plurality of electrostatic shields is located outside an inner peripheral end of the electric wire portion of the adjacent winding in the radial direction of the central axis.

Advantageous Effects of Invention

The present invention can reduce electric field concentration at at least any one of an outer peripheral end and an inner peripheral end of an electrostatic shield while restraining the electrostatic shield from thickening.

DESCRIPTION OF EMBODIMENTS

Figure 1:
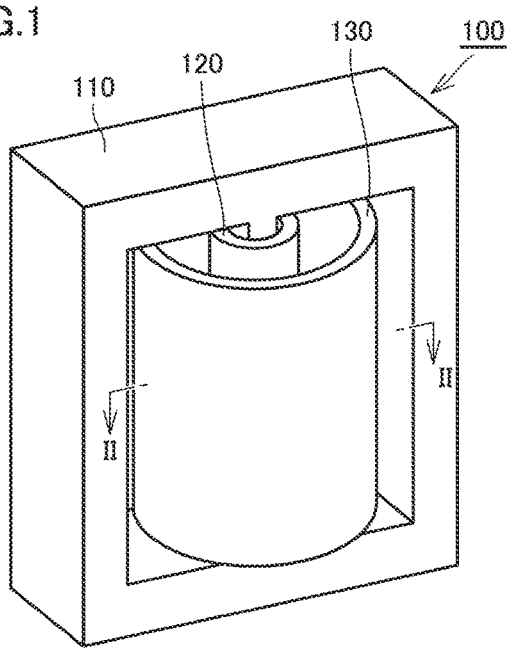
FIG. 1 is a perspective view showing an appearance of a stationary induction apparatus according to Embodiment 1 of the present invention.

Stationary induction apparatuses according to embodiments of the present invention will be described hereinafter with reference to the drawings. In the following embodiments, the same or corresponding components are denoted by the same reference numerals, and a description thereof will not be repeated.

Embodiment 1

Figure 2:
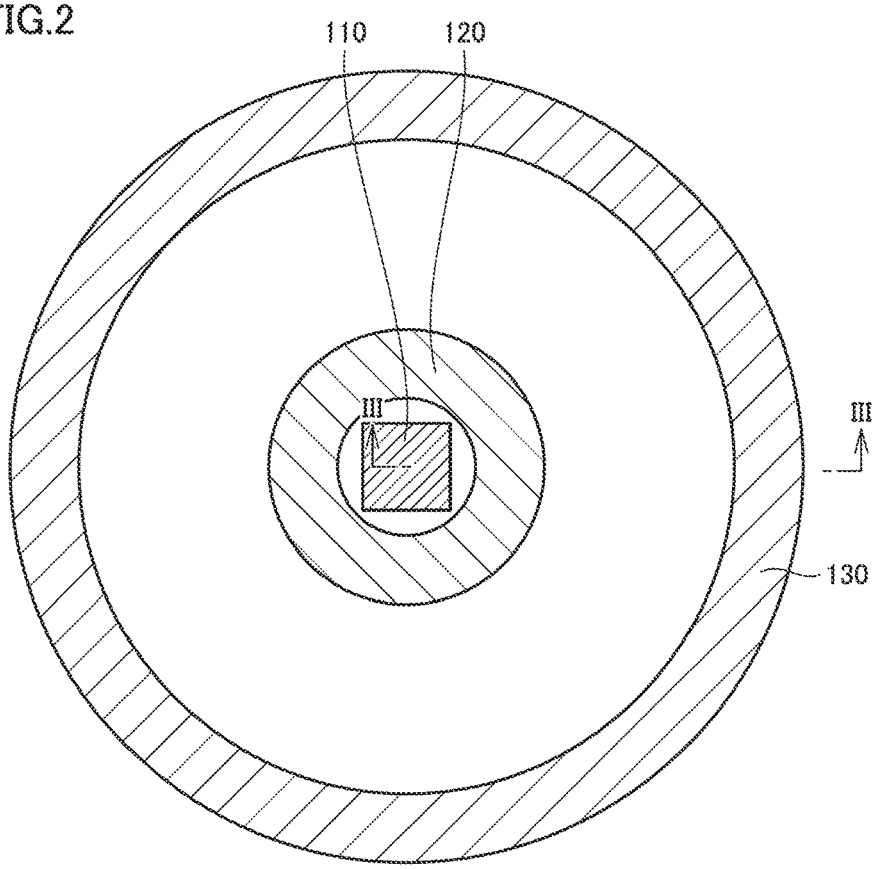
FIG. 2 is a sectional view of the stationary induction apparatus according to Embodiment 1 of the present invention, seen from the direction indicated by the arrow II-II of FIG. 1.
Figure 3:
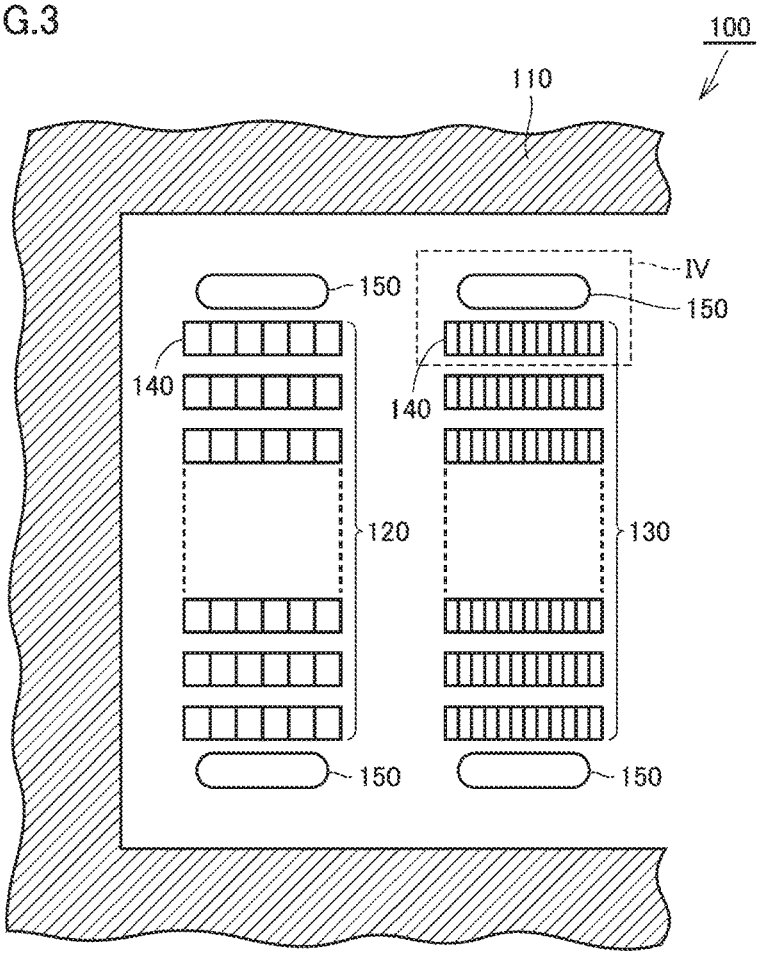
FIG. 3 is a sectional view of the stationary induction apparatus according to Embodiment 1 of the present invention, seen from the direction indicated by the arrow III-III of FIG. 2.
Figure 4:
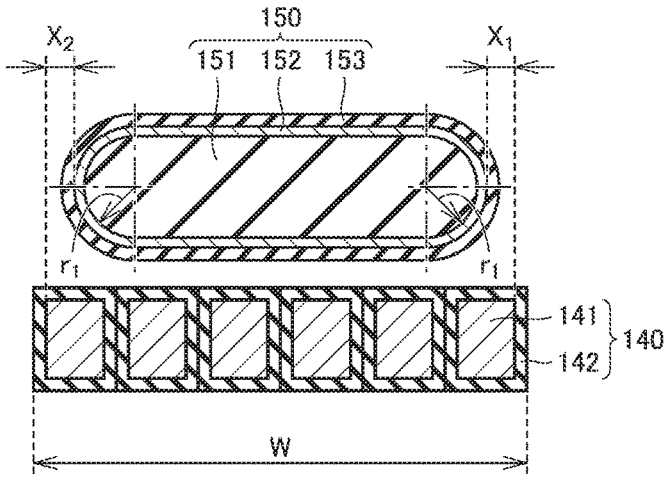
FIG. 4 is a sectional view of the stationary induction apparatus according to Embodiment 1 of the present invention, showing an enlarged IV portion of FIG. 3.

FIG. 1 is a perspective view showing the appearance of a stationary induction apparatus according to Embodiment 1 of the present invention. FIG. 2 is a sectional view of the stationary induction apparatus according to Embodiment 1 of the present invention, seen from the direction indicated by the arrow II-II of FIG. 1. FIG. 3 is a sectional view of the stationary induction apparatus according to Embodiment 1 of the present invention, seen from the direction indicated by the arrow III-III of FIG. 2. FIG. 4 is a sectional view of the stationary induction apparatus according to Embodiment 1 of the present invention, showing an enlarged IV portion of FIG. 3. It should be noted that FIG. 1 shows no electrostatic shields.

As shown in FIGS. 1 to 4, a stationary induction apparatus 100 according to Embodiment 1 of the present invention is a core-type transformer. Stationary induction apparatus 100 includes a core 110, and a low-voltage winding 120 and a high-voltage winding 130 concentrically wound around a main leg of core 110, where the main leg is the central axis.

Stationary induction apparatus 100 further includes a tank (not shown). The tank is filled with an insulating oil or $SF_6$ gas that is an insulating medium and cooling medium. Core 110, low-voltage winding 120, and high-voltage winding 130 are housed in the tank.

High-voltage winding 130 is located outside low-voltage winding 120. High-voltage winding 130 is formed of a plurality of discal windings layered axially of the central axis. Each of the windings is formed of a flat-type electric wire 140 wound in a disc shape. Flat-type electric wire 140 includes an electric wire portion 141, which has an approximately rectangular shape in transverse section, and a first insulating coating 142, which coats electric wire portion 141. Although not shown, low-voltage winding 120 also has a configuration similar to that of high-voltage winding 130.

Stationary induction apparatus 100 further includes four annular electrostatic shields 150 disposed adjacent to the respective ends of low-voltage winding 120 and high-voltage winding 130 in the direction extending along the central axis.

Each of the four electrostatic shields 150 includes an insulator 151, a conductor 152, and a second insulating coating 153, which coats conductor 152. In the present embodiment, conductor 152 is provided so as to cover the surface of insulator 151. Alternatively, insulator 151 may be formed of conductor 152. In other words, electrostatic shield 150 may be formed of conductor 152 and second insulating coating 153.

Insulator 151 is formed of press board or compressed wood. Conductor 152 is formed of wire net, metal foil, conductive tape, or conductive paint. Second insulating coating 153 is formed of press board or polyethylene terephthalate.

To reduce the amplitude of potential oscillations, electrostatic shield 150 needs to be at the same potential as the winding adjacent to electrostatic shield 150 when an impulse voltage enters stationary induction apparatus 100. If conductor 152 has a high electric resistivity, the potential of electrostatic shield 150 follows the electric resistivity slowly, leading to a situation where potential oscillations may be reduced insufficiently. Thus, conductor 152 preferably has a surface resistivity of 10 Ω/sq or more and 50 Ω/sq or less.

Each of the end on the outer peripheral side and the end on the inner peripheral side of electrostatic shield 150 is formed as a curved surface. In the present embodiment, each of the end on the outer peripheral side and the end on the inner peripheral side of electrostatic shield 150 is formed as a curved surface semicircular in transverse section. Specifically, each of the end on the outer peripheral side and the end on the inner peripheral side of electrostatic shield 150 is formed as a curved surface that has a radius $r_1$ and is semicircular in transverse section, and conductor 152 and second insulating coating 153 each have an outside shape substantially similar to the outside shape of insulator 151.

In the radial direction of the central axis, the width of electrostatic shield 150 is smaller than a width W of a winding adjacent to electrostatic shield 150. In other words, the width of electrostatic shield 150 adjacent to low-voltage winding 120 is smaller than the width of low-voltage winding 120. The width of electrostatic shield 150 adjacent to high-voltage winding 130 is smaller than the width of high-voltage winding 130.

The outer peripheral ends of the respective conductors 152 of four electrostatic shields 150 are located inside the outer peripheral ends of electric wire portions 141 of windings, which are adjacent to electrostatic shields 150 in the direction extending along the central axis, of low-voltage winding 120 and high-voltage winding 130 in the radial direction of the central axis. In the radial direction of the central axis, the distance by which the outer peripheral end of conductor 152 is located inside the outer peripheral end of electric wire portion 141 of the adjacent winding is $X_1$.

The inner peripheral ends of the respective conductors 152 of four electrostatic shields 150 are located outside the inner peripheral ends of electric wire portions 141 of the windings, which are adjacent to electrostatic shields 150 in the direction extending along the central axis, of low-voltage winding 120 and high-voltage winding 130 in the radial direction of the central axis. In the radial direction of the central axis, the distance by which the inner peripheral end of conductor 152 is located outside the inner peripheral end of electric wire portion 141 of the adjacent winding is $X_2$.

Figure 5:
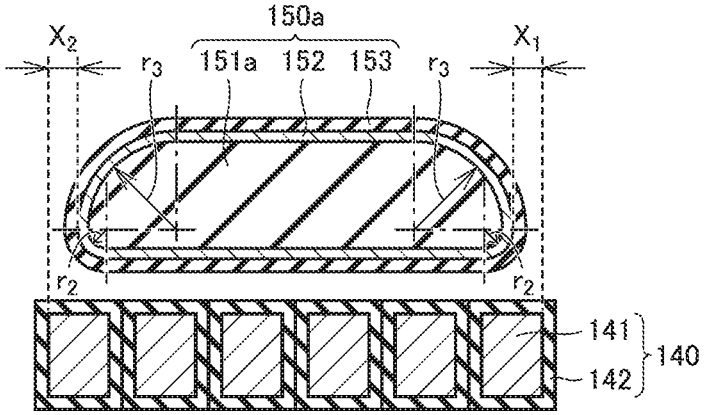
FIG. 5 is a sectional view showing a shape of an electrostatic shield according to Modification 1.
Figure 6:
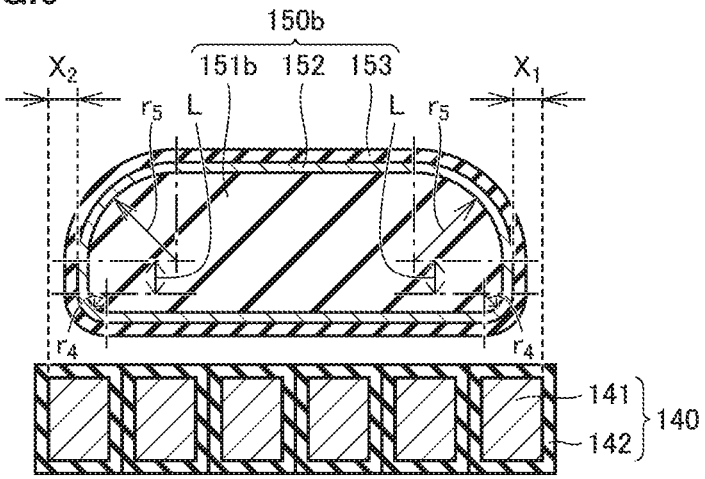
FIG. 6 is a sectional view showing a shape of an electrostatic shield according to Modification 2.

The shape of electrostatic shield 150 is not limited to the shape above. Modifications of the shape of the electrostatic shield will now be described. FIG. 5 is a sectional view showing the shape of an electrostatic shield according to Modification 1. FIG. 6 is a sectional view showing the shape of an electrostatic shield according to Modification 2. FIGS. 5 and 6 show the same sections as the section of FIG. 4.

As shown in FIG. 5, each of the end on the outer peripheral side and the end on the inner peripheral side of an electrostatic shield 150*a* according to Modification 1 is formed as a curved surface with two contiguous arc portions having different curvature radii in transverse section. Specifically, each of the end on the outer peripheral side and the end on the inner peripheral side of an insulator 151*a* is formed as a curved surface with an arc having a curvature radius $r_2$ and an arc having a curvature radius $r_3$ that are contiguous to each other in transverse section. Conductor 152 and second insulating coating 153 each have an outside shape substantially similar to the outside shape of insulator 151*a*.

Curvature radius $r_3$ is greater than curvature radius $r_2$. In electrostatic shield 150*a*, the arc having curvature radius $r_2$ is provided on the winding side adjacent to electrostatic shield 150*a*, and the arc having curvature radius $r_3$ is provided opposite to the winding adjacent to electrostatic shield 150*a*.

Each of the end on the outer peripheral side and the end on the inner peripheral side of electrostatic shield 150*a* may be formed as a curved surface with three or more continuous arcs having different curvature radii in transverse section. In this case, in electrostatic shield 150*a*, arcs are provided opposite to the winding adjacent to electrostatic shield 150*a* in descending order of curvature radii.

As shown in FIG. 6, each of the end on the outer peripheral side and the end on the inner peripheral side of an electrostatic shield 150*b* according to Modification 2 is formed as a curved surface with two arcs having different curvature radii and one straight portion that are contiguous to each other in transverse section. Specifically, each of the end on the outer peripheral side and the end on the inner peripheral side of insulator 151*b* is formed as a curved surface with an arc having a curvature radius $r_4$, a straight portion having a length L, and an arc having a curvature radius $r_5$ that are contiguous to each other in transverse section, and conductor 152 and second insulating coating 153 each have an outside shape substantially similar to the outside shape of insulator 151*b*.

Curvature radius $r_5$ is greater than curvature radius $r_4$. In electrostatic shield 150*b*, the arc having curvature radius $r_4$ is provided on the winding side adjacent to electrostatic shield 150*b*, and the arc having curvature radius $r_5$ is provided opposite to the winding adjacent to electrostatic shield 150*b*. The straight portion is provided between the arc having curvature radius $r_4$ and the arc having curvature radius $r_5$.

Each of the end on the outer peripheral side and the end on the inner peripheral side of electrostatic shield 150*b* may be formed as a curved surface with three or more arcs having different curvature radii and a straight portion that are contiguous to each other in transverse section. In this case, in electrostatic shield 150*b*, arcs are provided opposite to the winding adjacent to electrostatic shield 150*b* in descending order of curvature radii.

Description will now be given of the results obtained by simulation analysis of the electric field distribution occurring at the outer peripheral end of electrostatic shield 150*a* in the stationary induction apparatus according to Modification 1 of the present embodiment and the electric field distribution occurring at the outer peripheral end of the electrostatic shield in the stationary induction apparatus according to a comparative example. It should be noted that the same also holds true for an electric field generated at the inner peripheral end of the electrostatic shield.

Figure 7:
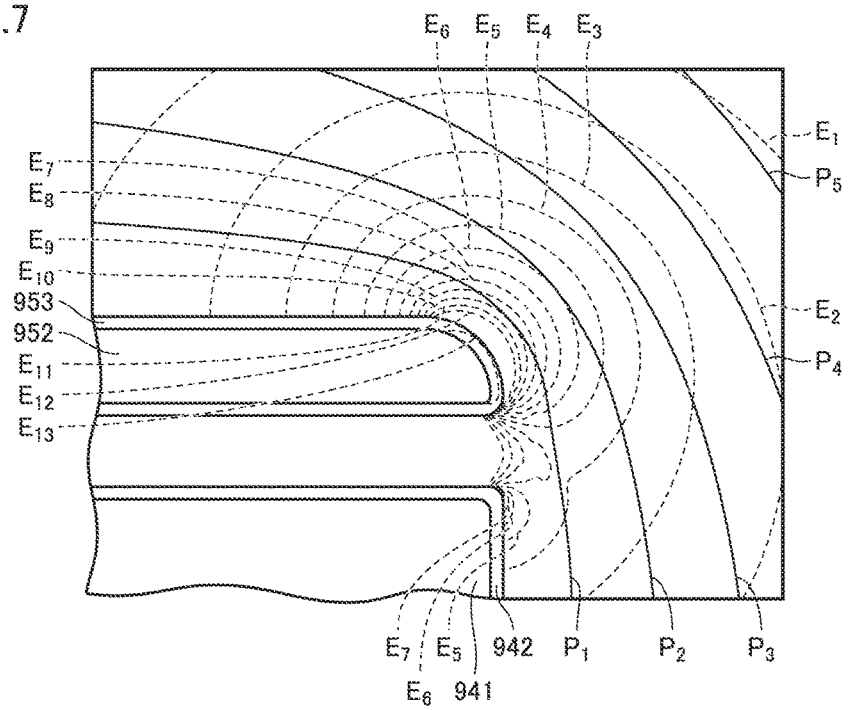
FIG. 7 shows the electric field distribution occurring at an outer peripheral end of an electrostatic shield in a stationary induction apparatus according to a comparative example.
Figure 8:
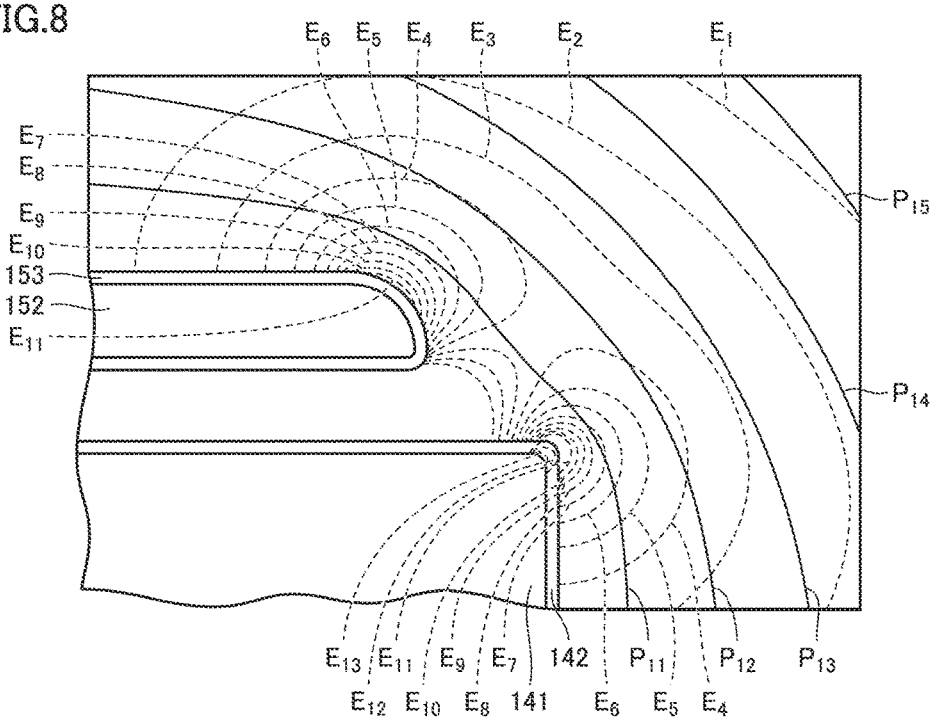
FIG. 8 shows the electric field distribution occurring at an outer peripheral end of an electrostatic shield in a stationary induction apparatus according to Modification 1 of the present embodiment.

FIG. 7 shows the electric field distribution occurring at the outer peripheral end of the electrostatic shield in the stationary induction apparatus according to the comparative example. FIG. 8 shows the electric field distribution occurring at the outer peripheral end of the electrostatic shield in the stationary induction apparatus according to Modification 1 of the present embodiment. FIG. 7 shows equipotential lines $P_1$ to $P_5$ and equi-field lines $E_1$ to $E_{13}$, and FIG. 8 shows equipotential lines $P_{11}$ to $P_{15}$ and equi-field lines $E_1$ to $E_{13}$.

Among equipotential lines $P_1$ to $P_5$, equipotential line $P_1$ has the highest potential, and equipotential line $P_5$ has the lowest potential. Among equipotential lines $P_{11}$ to $P_{15}$, equipotential line $P_{11}$ has the highest potential, and equipotential line $P_{15}$ has the lowest potential. Among equi-field lines $E_1$ to $E_{13}$, equi-field line $E_1$ has the lowest potential, and equi-field line $E_{13}$ has the highest potential.

As shown in FIG. 7, the stationary induction apparatus according to the comparative example includes a winding and an electrostatic shield disposed adjacent to the winding. The winding is formed of a plurality of discal windings layered axially of the central axis. Each of the windings is formed of a flat-type electric, including an electric wire portion 941 and a first insulating coating 942 that coats electric wire portion 941, wound in a disc shape. The electrostatic shield includes a conductor 952 and a second insulating coating 953 that coats conductor 952. The outside shape of the end on the outer peripheral side of conductor 952 is identical to the outside shape of the end on the outer peripheral side of conductor 152 according to Modification 1 of the present embodiment.

In the stationary induction apparatus according to the comparative example, the outer peripheral end of conductor 952 in the electrostatic shield is located at the same position in the radial direction of the central axis as the outer peripheral end of electric wire portion 941 of the winding adjacent to the shield in the central axis.

In the stationary induction apparatus according to the comparative example, equipotential line $P_1$ curves along the arc of conductor 952 opposite to the winding adjacent to the electrostatic shield. Equi-field line $E_{13}$ having the highest electric field appears in the vicinity of the outer peripheral end of conductor 952. Equi-field line $E_7$ appears in the vicinity of the outer peripheral end of electric wire portion 941.

As shown in FIG. 8, in the stationary induction apparatus according to Modification 1 of the present embodiment, equipotential line $P_{11}$ curves along a virtual arc having, as its curvature radius, a total value of the distance between the winding adjacent to electrostatic shield 150*a* and electrostatic shield 150*a* and the thickness of electrostatic shield 150*a*. Equi-field line $E_{11}$ appears in the vicinity of the outer peripheral end of conductor 152. Equi-field line $E_{13}$ having the highest electric field appears in the vicinity of the outer peripheral end of electric wire portion 141.

The stationary induction apparatus according to Modification 1 of the present embodiment can, compared with the stationary induction apparatus according to the comparative example, provide gradual changes in potential in the vicinity of the outer peripheral end of the conductor of the electrostatic shield. This mitigates an electric field generated at the outer peripheral end of the conductor of the electrostatic shield, thus allowing the electric field to be smaller than the electric field generated at the outer peripheral end of the electric wire portion of the winding adjacent to the electrostatic shield.

Description will now be given of the results obtained by simulation analysis of the relationship between the distance $X_1$ above and each of an electric field generated at the outer peripheral end of the conductor of the electrostatic shield and an electric field generated at the outer peripheral end of the electric wire portion of the winding, and the relationship between the distance $X_2$ above and each electric field generated at the inner peripheral end of the conductor of the electrostatic shield and an electric field generated at the inner peripheral end of the electric wire portion of the winding.

Figure 9:
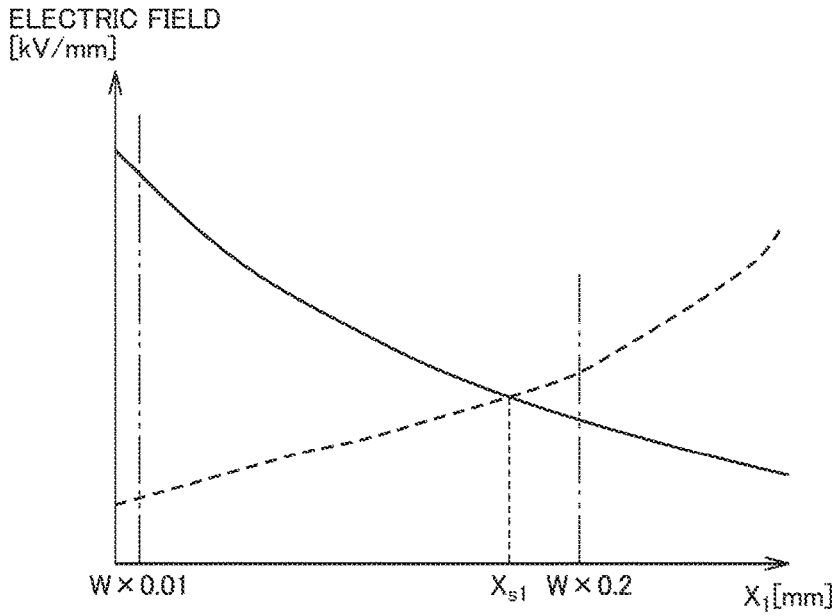
FIG. 9 is a graph showing the relationship between a distance $X_1$ and each of an electric field generated at an outer peripheral end of a conductor of an electrostatic shield and an electric field generated at an outer peripheral end of an electric wire portion of a winding adjacent to the electrostatic shield.
Figure 10:
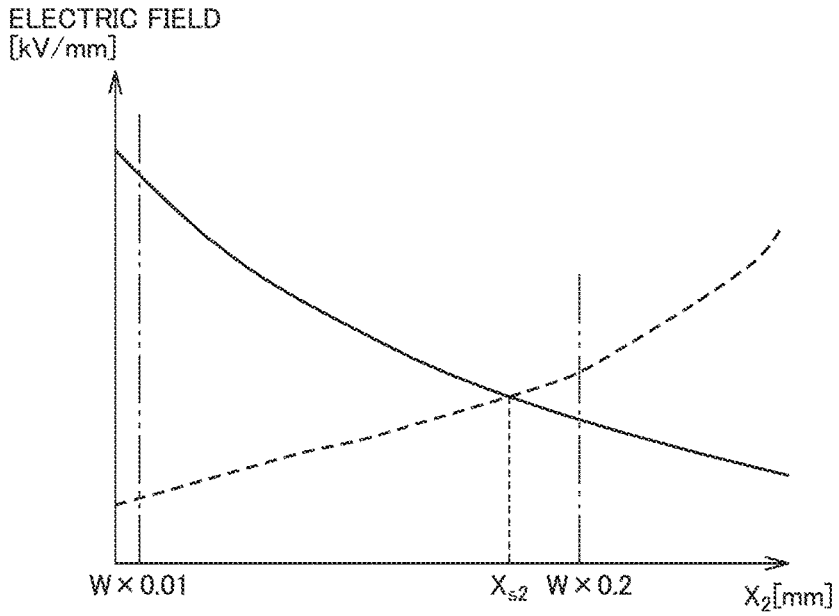
FIG. 10 is a graph showing the relationship between a distance $X_2$ and each of an electric field generated at an inner peripheral end of a conductor of an electrostatic shield and an electric field generated at an inner peripheral end of an electric wire portion of a winding adjacent to the electrostatic shield.

FIG. 9 is a graph showing the relationship between distance $X_1$ and each of an electric field generated at the outer peripheral end of the conductor of the electrostatic shield and an electric field generated at the outer peripheral end of the electric wire portion of the winding adjacent to the electrostatic shield. FIG. 10 is a graph showing the relationship between distance $X_2$ and each of an electric field generated at the inner peripheral end of the conductor of the electrostatic shield and an electric field generated at the inner peripheral end of the electric wire portion of the winding adjacent to the electrostatic shield.

In FIGS. 9 and 10, the vertical axis represents an electric field (kV/mm), and the horizontal axis represents distances $X_1$ and $X_2$ (mm). In FIG. 9, an electric field generated at the outer peripheral end of the conductor of the electrostatic shield is indicated by a solid line, and an electric field generated at the outer peripheral end of the electric wire portion of the winding adjacent to the electrostatic shield is indicated by a dotted line. In FIG. 10, an electric field generated at the inner peripheral end of the conductor of the electrostatic shield is indicated by a solid line, and an electric field generated at the inner peripheral end of the electric wire portion of the winding adjacent to the electrostatic shield is indicated by a dotted line.

As shown in FIGS. 9 and 10, electric fields generated at the outer peripheral end and inner peripheral end of the conductor of the electrostatic shield can be made smaller as distances $X_1$ and $X_2$ become greater. On the other hand, electric fields generated at the outer peripheral end and inner peripheral end of the electric wire portion of the winding adjacent to the electrostatic shield become greater as distances $X_1$ and $X_2$ become greater.

Let a distance $X_1$, with which the magnitude of an electric field generated at the outer peripheral end of the conductor of the electrostatic shield is equal to the magnitude of an electric field generated at the outer peripheral end of the electric wire portion of the winding adjacent to the electrostatic shield, be a distance $X_{s1}$. Let a distance $X_2$, with which the magnitude of an electric field generated at the inner peripheral end of the conductor of the electrostatic shield is equal to the magnitude of an electric field generated at the inner peripheral end of the electric wire portion of the winding adjacent to the electrostatic shield, be a distance $X_{s2}$.

In the present embodiment, distance $X_1$ is smaller than distance $X_{s1}$, and distance $X_2$ is smaller than distance $X_{s2}$. Distance $X_{s1}$ and distance $X_{s2}$ each change depending on the configuration of a stationary induction apparatus. Typically, distance $X_{s1}$ is not equal to distance $X_{s2}$, and the magnitude relationship between distance $X_{s1}$ and distance $X_{s2}$ changes depending on the configuration of a stationary induction apparatus. It should be noted that distances $X_1$ and $X_2$ are each 1% or more and 20% or less of width W of the winding adjacent to the electrostatic shield.

Figure 11:
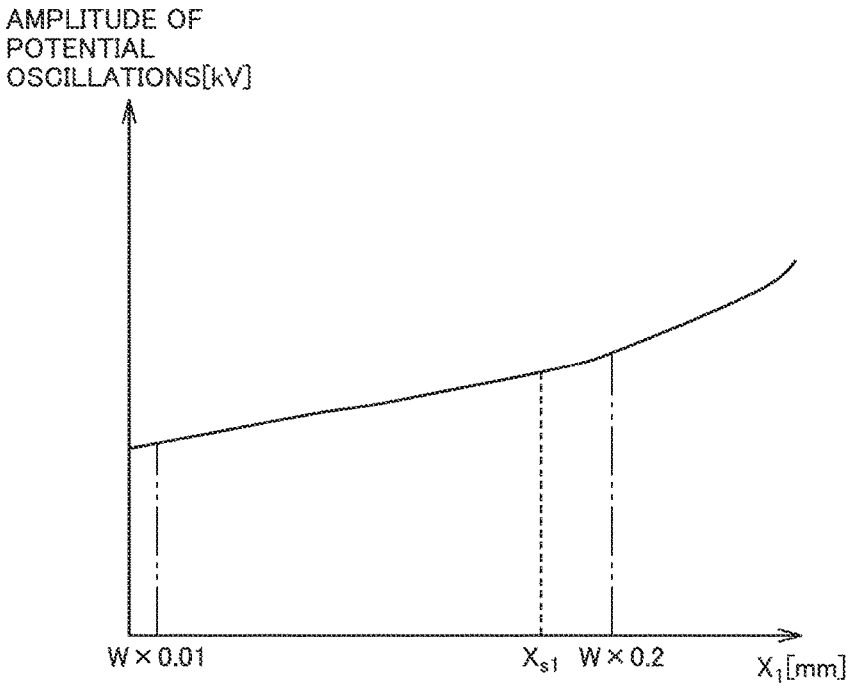
FIG. 11 is a graph showing the relationship between an amplitude of potential oscillations immediately after the application of an impulse voltage and a distance $X_1$.
Figure 12:
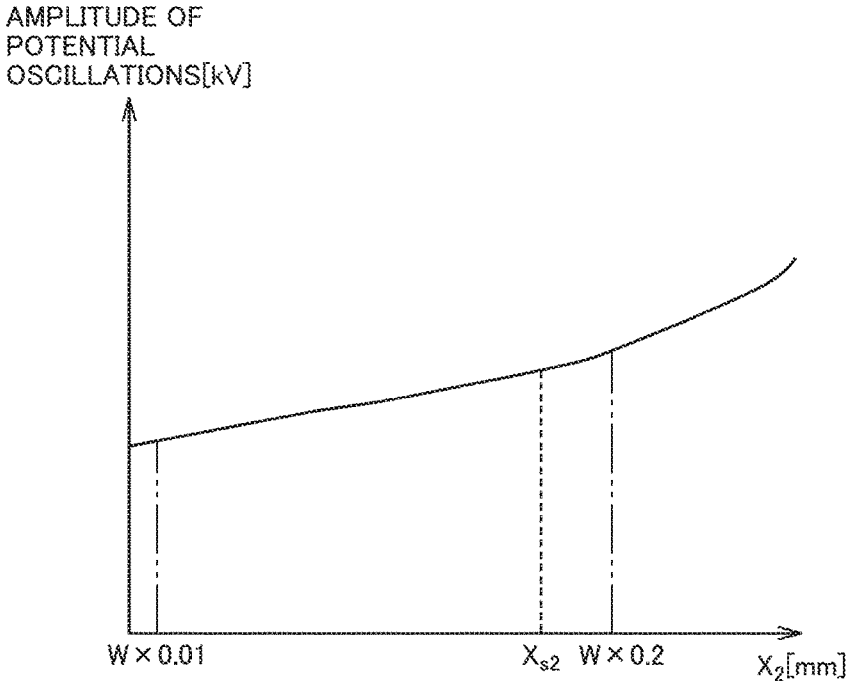
FIG. 12 is a graph showing the relationship between an amplitude of potential oscillations immediately after the application of an impulse voltage and a distance $X_2$.

Description will now be given of the results obtained by simulation analysis of an amplitude of potential oscillations immediately after the application of an impulse voltage and each of distances $X_1$ and $X_2$. FIG. 11 is a graph showing the relationship between an amplitude of potential oscillations immediately after the application of an impulse voltage and distance $X_1$. FIG. 12 is a graph showing the relationship between an amplitude of potential oscillations immediately after the application of an impulse voltage and distance $X_2$. In FIGS. 11 and 12, the vertical axis represents an amplitude (kV) of potential oscillations immediately after the application of an impulse voltage, and the horizontal axis represents distances $X_1$ and $X_2$ (mm).

As shown in FIGS. 11 and 12, an area with which the winding adjacent to the electrostatic shield faces the electrostatic shield becomes smaller as distances $X_1$ and $X_2$ become greater, and accordingly, the electrostatic capacity between the winding adjacent to the electrostatic shield and the electrostatic shield becomes smaller. This reduces the effect of reducing an amplitude of potential oscillations by the electrostatic shield. In the present embodiment, distance $X_1$ is smaller than distance $X_{s1}$, and distance $X_2$ is smaller than distance $X_{s2}$, and thus, the effect of reducing the amplitude of potential oscillations by the electrostatic shield can be achieved sufficiently.

As described above, in stationary induction apparatus 100 according to the present embodiment, electrostatic shield 150 can mitigate electric field concentration at the outer peripheral end and inner peripheral end of electrostatic shield 150 and also reduce the amplitude of potential oscillations. Additionally, there is no need to thicken electrostatic shield 150. In other words, stationary induction apparatus 100 can mitigate electric field concentration at the outer peripheral end and inner peripheral end of electrostatic shield 150 while restraining electrostatic shield 150 from thickening.

Stationary induction apparatus 100 according to the present embodiment satisfies both the positional relationship in which the outer peripheral end of conductor 152 in electrostatic shield 150 is located inside the outer peripheral end of electric wire portion 141 of the winding adjacent to the electrostatic shield in the radial direction of the central axis, and the positional relationship in which the inner peripheral end of conductor 152 in electrostatic shield 150 is located outside the inner peripheral end of electric wire portion 141 of the adjacent winding in the radial direction of the central axis. Alternatively, the configuration capable of reducing electric field concentration at the end of electrostatic shield 150 will suffice, and the configuration that satisfies only any one of the positional relationships above will suffice.

Embodiment 2

A stationary induction apparatus according to Embodiment 2 of the present invention will be described hereinafter. A stationary induction apparatus 200 according to the present embodiment differs from stationary induction apparatus 100 according to Embodiment 1 only in the configuration of an electrostatic shield, and thus, the components similar to those of stationary induction apparatus 100 according to Embodiment 1 are denoted by the same reference numerals, and description thereof will not be repeated.

Figure 13:
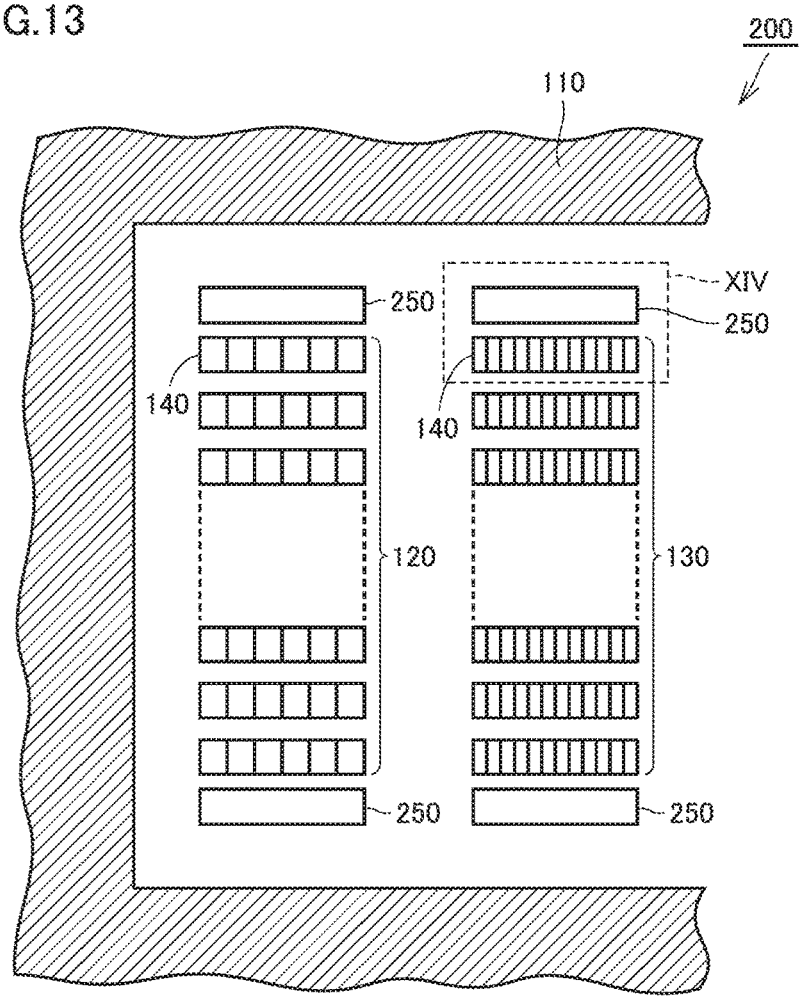
FIG. 13 is a sectional view of a stationary induction apparatus according to Embodiment 2 of the present invention.
Figure 14:
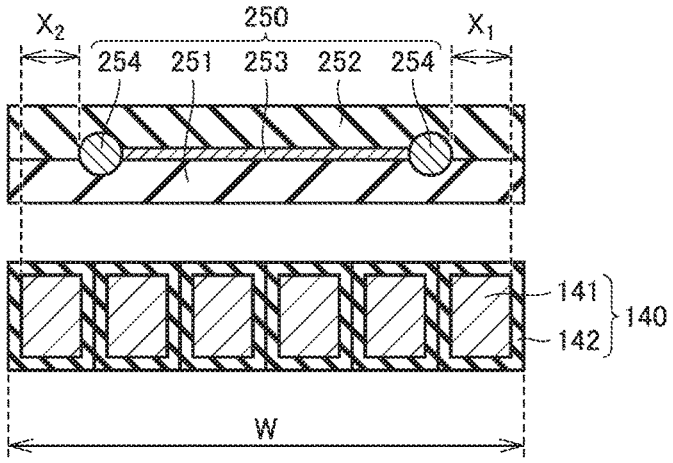
FIG. 14 is a sectional view of the stationary induction apparatus according to Embodiment 2 of the present invention, showing an enlarged XIV portion of FIG. 13.

FIG. 13 is a sectional view of the stationary induction apparatus according to Embodiment 2 of the present invention. FIG. 13 shows the same section as that of FIG. 13. FIG. 14 is a sectional view of the stationary induction apparatus according to Embodiment 2 of the present invention, showing an enlarged XIV portion of FIG. 13.

As shown in FIGS. 13 and 14, stationary induction apparatus 200 according to Embodiment 2 of the present invention includes four annular electrostatic shields 250 disposed adjacent to the respective ends of low-voltage winding 120 and high-voltage winding 130 in the direction extending along the central axis.

Four electrostatic shields 250 each include a conductor and a second insulating coating that coats the conductor. The conductor includes an annular base 253 extending in the radial direction of the central axis and a pair of extensions 254 individually extended from the opposite ends of the base 253 in the radial direction of the central axis. In each of the pair of extensions 254, at least a surface opposite to the winding in the radial direction of the central axis is rounded.

In the present embodiment, each of the pair of extensions 254 has an outside shape circular in transverse section. Base 253 extends in the radial direction of the central axis so as to connect the centers of the pair of extensions 254 to each other. Base 253 is thinner than each of the pair of extensions 254.

The second insulating coating includes a first insulator 251 disposed on the winding side adjacent to electrostatic shield 250, and a second insulator 252 disposed opposite to the winding adjacent to electrostatic shield 250.

Each of the surfaces of first insulator 251 and second insulator 252 that face each other is provided with an annular groove corresponding to the outside shape of the conductor. First insulator 251 and second insulator 252 are bonded to each other with an adhesive applied to the entire surfaces of their facing surfaces.

First insulator 251 and second insulator 252 are each formed of press board or compressed wood. Base 253 is formed of wire net, metal foil, conductive tape, or conductive paint. The pair of extensions 254 are formed of bare electric wire, coated electric wire, or conductive paint.

When the pair of extensions 254 are formed of conductive paint, any protrusion of the conductive paint from the groove causes an electric field to be concentrated on the protrusion. Thus, the protrusion of the conductive paint from the groove needs to be prevented.

In the present embodiment, in the radial direction of the central axis, the width of electrostatic shield 250 is substantially identical to a width W of the winding adjacent to electrostatic shield 250. In the radial direction of the central axis, the width of the conductor of electrostatic shield 250 is smaller than a width W of a winding adjacent to electrostatic shield 150.

Figure 15:
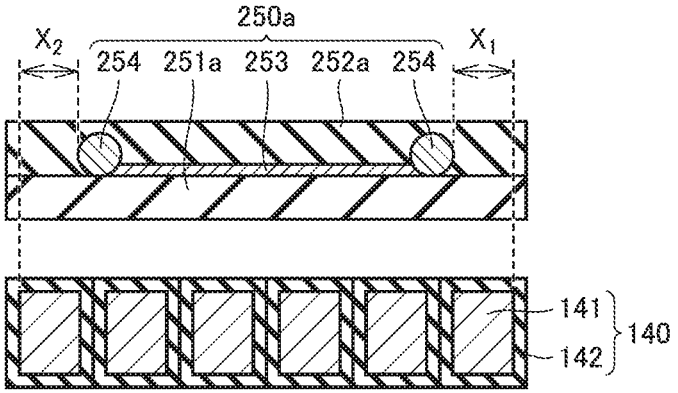
FIG. 15 is a sectional view showing a shape of an electrostatic shield according to Modification 3.
Figure 16:
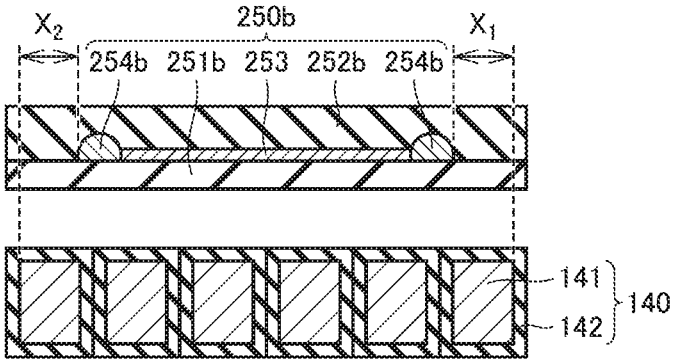
FIG. 16 is a sectional view showing a shape of an electrostatic shield according to Modification 4.

The shape of electrostatic shield 250 is not limited to the shape above. Modifications of the shape of the electrostatic shield will now be described. FIG. 15 is a sectional view showing the shape of an electrostatic shield according to Modification 3. FIG. 16 is a sectional view showing the shape of an electrostatic shield according to Modification 4. FIGS. 15 and 16 show the same sections as the section of FIG. 14.

As shown in FIG. 15, in an electrostatic shield 250*a* according to Modification 3, a base 253 of a conductor extends in the radial direction of the central axis so as to connect the respective ends of a pair of extensions 254 on the winding side of the electrostatic shield adjacent to the electrostatic shield to each other Only the surface of second insulator 252*a* that faces first insulator 251*a* is provided with an annular groove corresponding to the outside shape of the conductor. In other words, no groove is provided in first insulator 251*a*, thus reducing the time for processing first insulator 251*a*.

As shown in FIG. 16, in an electrostatic shield 250*b* according to Modification 4, a pair of extensions 254*b* each have an outside shape semicircular in transverse section. In each of the pair of extensions 254*b*, a surface opposite to the winding in the radial direction of the central axis is rounded. Only the surface of a second insulator 252*b* that faces a first insulator 251*b* is provided with an annular groove corresponding to the outside shape of the conductor. In other words, no groove is provided in first insulator 251*b*, thus reducing the time for processing first insulator 251*b*.

Although the first insulator and second insulator each have an outside shape substantially rectangular in section as shown in FIGS. 14 to 16, they may each have a curved portion in section. However, a rectangular outside shape allows the first insulator and second insulator to be manufactured more easily and also allows electrostatic shield 250 to be held more easily.

The width of electrostatic shield 250 may be smaller than a width W of the winding adjacent to electrostatic shield 250. However, the electrostatic shield 250 can be held more easily when the width of electrostatic shield 250 is identical to width W of the winding adjacent to electrostatic shield 250.

The outer peripheral ends of the respective conductors of four electrostatic shields 250 are located inside the outer peripheral ends of electric wire portions 141, which are adjacent to the electrostatic shields in the direction extending along the central axis, of the windings of low-voltage winding 120 and high-voltage winding 130 in the radial direction of the central axis. In the radial direction of the central axis, the distance by which the outer peripheral end of the conductor is located inside the outer peripheral end of the electric wire portion 141 of the winding adjacent to the electrostatic shield is $X_1$.

The inner peripheral ends of the respective conductors of four electrostatic shields 250 are located outside the inner peripheral ends of electric wire portions 141 of the windings, which are adjacent to the electrostatic shields in the direction extending along the central axis, of low-voltage winding 120 and high-voltage winding 130 in the radial direction of the central axis. In the radial direction of the central axis, the distance by which the inner peripheral end of the conductor is located outside the inner peripheral end of electric wire portion 141 of the winding adjacent to the electrostatic shield is $X_2$.

Also in stationary induction apparatus 200 according to the present embodiment, electrostatic shield 250 can mitigate electric field concentration at the outer peripheral end and inner peripheral end of electrostatic shield 250 and also reduce the amplitude of potential oscillations. Additionally, there is no need to thicken electrostatic shield 250. In other words, stationary induction apparatus 200 can mitigate electric field concentration at the outer peripheral end and inner peripheral end of electrostatic shield 250 while restraining electrostatic shield 250 from thickening.

Further, stationary induction apparatus 200 according to the present embodiment can keep the distance between the conductor of electrostatic shield 250 and core 110 long to reduce an average electric field from core 110 to electrostatic shield 250, further mitigating electric field concentration at the outer peripheral end and inner peripheral end of electrostatic shield 250.

Embodiment 3

A stationary induction apparatus according to Embodiment 3 of the present invention will be described hereinafter. A stationary induction apparatus 300 according to the present embodiment differs from stationary induction apparatus 100 according to Embodiment 1 mainly in that it is a shell-type transformer, and accordingly, the description of the components similar to those of stationary induction apparatus 100 according to Embodiment 1 will not be repeated.

Figure 17:
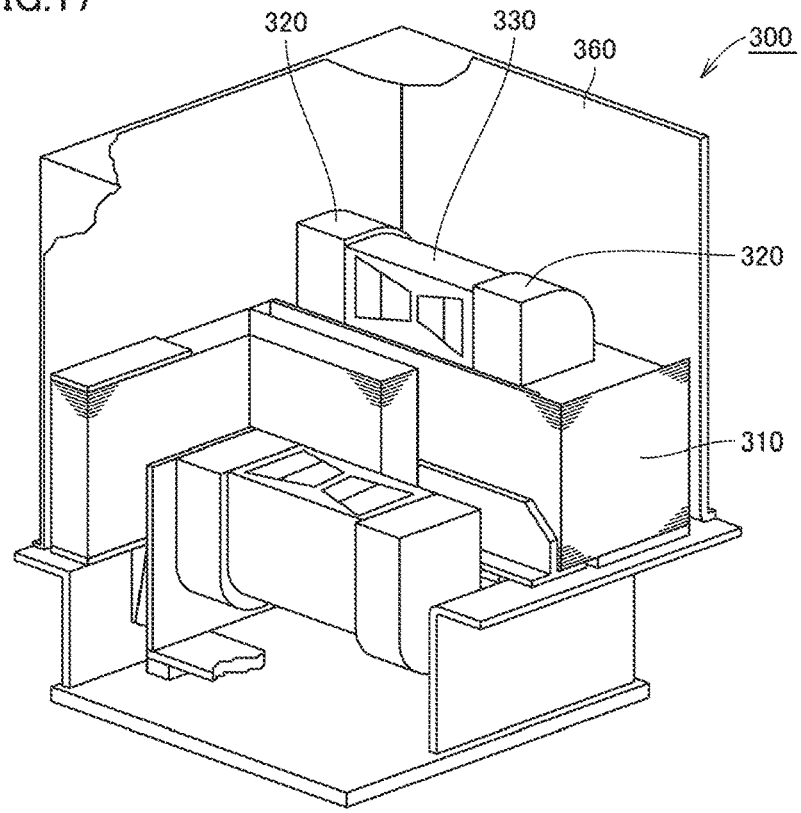
FIG. 17 is a perspective view showing an appearance of a stationary induction apparatus according to Embodiment 3 of the present invention.
Figure 18:
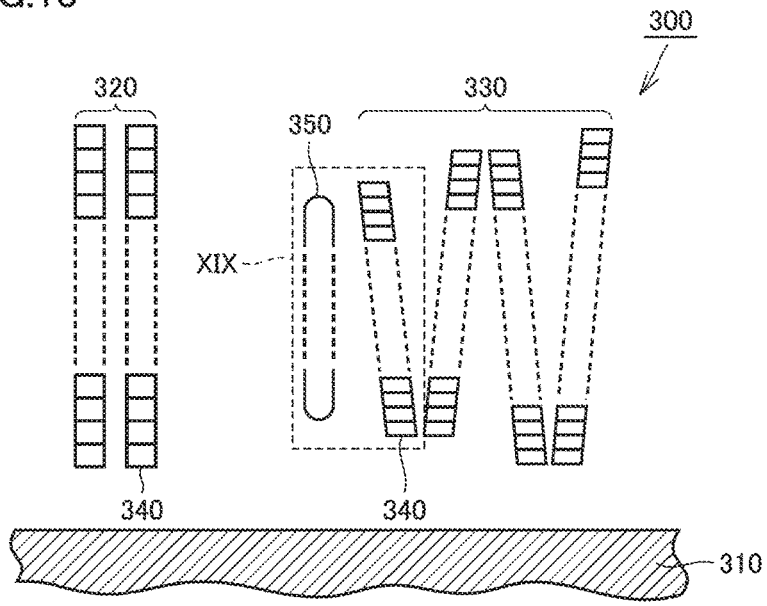
FIG. 18 is a partial sectional view of the stationary induction apparatus according to Embodiment 3 of the present invention.
Figure 19:
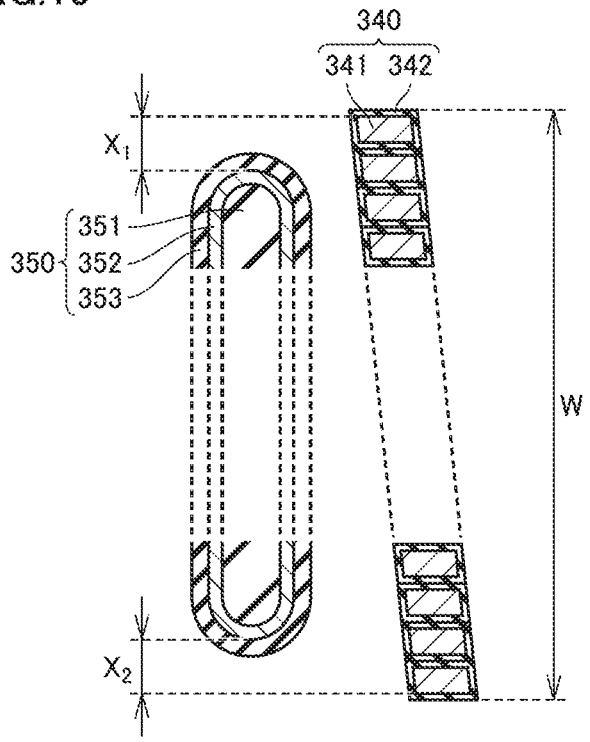
FIG. 19 is a sectional view of the stationary induction apparatus according to Embodiment 3 of the present invention, showing an enlarged XIX portion of FIG. 18.

FIG. 17 is a perspective view showing an appearance of the stationary induction apparatus according to Embodiment 3 of the present invention. FIG. 18 is a partial sectional view of the stationary induction apparatus according to Embodiment 3 of the present invention. FIG. 19 is a sectional view of the stationary induction apparatus according to Embodiment 3 of the present invention, showing an enlarged XIX portion of FIG. 18. It should be noted that FIG. 17 shows no electrostatic shields. FIG. 18 shows only the portion above a core 310.

As shown in FIGS. 17 to 19, stationary induction apparatus 300 according to Embodiment 3 of the present invention is a shell-type transformer. Stationary induction apparatus 300 includes core 310, and a low-voltage windings 320 and a high-voltage winding 330 wound around a main leg of core 310 to be coaxially disposed, where the main leg is the central axis.

Stationary induction apparatus 300 further includes a tank 360. Tank 360 is filled with an insulating oil or $SF_6$ gas that is an insulating medium and cooling medium. Core 310, low-voltage windings 320, and high-voltage winding 330 are housed in tank 360.

Axially of the central axis, high-voltage winding 330 is disposed so as to be sandwiched between low-voltage windings 320. High-voltage winding 330 is formed of a plurality of rectangular windings layered axially of the central axis. Each of the windings is formed of a flat-type electric wire 340 wound in a substantially rectangular shape. Flat-type electric wire 340 includes an electric wire portion 341 substantially rectangular in transverse section and a first insulating coating 342 that coats electric wire portion 341. Although not shown, low-voltage winding 320 also has a configuration similar to that of high-voltage winding 330.

Stationary induction apparatus 300 further includes a plurality of annular electrostatic shields 350 disposed adjacent to the respective ends of low-voltage windings 320 and high-voltage winding 330 in the direction extending along the central axis. It should be noted that FIGS. 18 and 19 show only one electrostatic shield 350 adjacent to high-voltage winding 330.

Electrostatic shields 350 each include an insulator 351, a conductor 352, and a second insulating coating 353 that coats conductor 352. In the present embodiment, conductor 352 is provided so as to cover the surface of insulator 351. Alternatively, insulator 351 may be formed of conductor 352. In other words, electrostatic shield 350 may be formed of conductor 352 and second insulating coating 353.

Insulator 351 is formed of press board or compressed wood. Conductor 352 is formed of wire net, metal foil, conductive tape, or conductive paint. Second insulating coating 353 is formed of press board or polyethylene terephthalate.

To reduce the amplitude of potential oscillations, electrostatic shield 350 needs to be at the same potential as the winding adjacent to electrostatic shield 350 when an impulse voltage enters stationary induction apparatus 300. If conductor 352 has a high electric resistivity, the potential of electrostatic shield 350 follows the electric resistivity slowly, leading to a situation where potential oscillations may be reduced insufficiently. Thus, conductor 352 preferably has a surface resistivity of 10 Ω/sq or more and 50 Ω/sq or less.

Each of the end on the outer peripheral side and the end on the inner peripheral side of electrostatic shield 350 is formed as a curved surface. In the present embodiment, each of the end on the outer peripheral side and the end on the inner peripheral side of electrostatic shield 350 is formed as a curved surface semicircular in transverse section. Specifically, each of the end on the outer peripheral side and the end on the inner peripheral side of electrostatic shield 350 is formed as a curved surface semicircular in transverse section, and conductor 352 and second insulating coating 353 each have an outside shape substantially similar to the outside shape of insulator 351.

In the radial direction of the central axis, the width of electrostatic shield 350 is smaller than a width W of a winding adjacent to electrostatic shield 350. In other words, the width of electrostatic shield 350 adjacent to low-voltage winding 320 is smaller than the width of low-voltage winding 320. The width of electrostatic shield 350 adjacent to high-voltage winding 330 is smaller than the width of high-voltage winding 330.

The outer peripheral ends of the respective conductors 352 of electrostatic shields 350 are located inside the outer peripheral ends of electric wire portions 341 of windings, which are adjacent to the electrostatic shields in the direction extending along the central axis, of low-voltage windings 320 and high-voltage winding 330 in the radial direction of the central axis. In the radial direction of the central axis, the distance by which the outer peripheral end of conductor 352 is located inside the outer peripheral end of electric wire portion 341 of the winding adjacent to the electrostatic shield is $X_1$.

The inner peripheral ends of the respective conductors 352 of electrostatic shields 350 are located outside the inner peripheral ends of electric wire portions 341 of the windings, which are adjacent to the electrostatic shields in the direction extending along the central axis, of low-voltage windings 320 and high-voltage winding 330 in the radial direction of the central axis. In the radial direction of the central axis, the distance by which the inner peripheral end of conductor 352 is located outside the inner peripheral end of electric wire portion 341 of the winding adjacent to the electrostatic shield is $X_2$.

The shape of electrostatic shield 350 is not limited to the shape above and may be, for example, the shape of Modification 1 or the shape of Modification 2 described in Embodiment 1, or the shape of Embodiment 2, or the shape of Modification 3 or the shape of Modification 4 described in Embodiment 2.

Also in stationary induction apparatus 300 according to the present embodiment, electrostatic shield 350 can mitigate electric field concentration at the outer peripheral end and inner peripheral end of electrostatic shield 350 and also reduce the amplitude of potential oscillations. Additionally, there is no need to thicken electrostatic shield 350. In other words, stationary induction apparatus 300 can mitigate electric field concentration at the outer peripheral end and inner peripheral end of electrostatic shield 350 while restraining electrostatic shield 350 from thickening.

While the core type transformer and shell-type transformer have been described as a stationary induction apparatus in the embodiments above, the stationary induction apparatus may be any other stationary induction apparatus such as a reactor.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

REFERENCE SIGNS LIST

100, 200, 300 stationary induction apparatus, 110, 310 core, 120, 320 low-voltage winding, 130, 330 high-voltage winding, 140, 340 flat-type electric wire, 141, 341, 941 electric wire portion, 142, 342, 942 first insulating coating, 150, 150*a*, 150*b*, 250, 250*a*, 250*b*, 350 electrostatic shield, 151, 151*a*, 151*b*, 351 insulator, 152, 352, 952 conductor, 153, 353, 953 second insulating coating, 251, 251*a*, 251*b* first insulator, 252, 252*a*, 252*b* second insulator, 253 base, 254, 254*b* extension, 360 tank.

The invention claimed is:

1. A stationary induction apparatus comprising:
a core;
a plurality of windings wound around the core that is a central axis; and
a plurality of annular electrostatic shields disposed adjacent to respective ends of the plurality of windings in a direction extending along the central axis,
each of the plurality of windings including
an electric wire portion, and
a first insulating coating that coats the electric wire portion,
each of the plurality of electrostatic shields including
a conductor, and
a second insulating coating that coats the conductor,
the stationary induction apparatus satisfying at least one positional relationship among
a positional relationship in which an outer peripheral end of the conductor in each of the plurality of electrostatic shields is located inside an outer peripheral end of the electric wire portion of an adjacent winding among the plurality of windings, the adjacent winding being adjacent to the electrostatic shield in the direction extending along the central axis, and
a positional relationship in which an inner peripheral end of the conductor in each of the plurality of electrostatic shields is located outside an inner peripheral end of the electric wire portion of the adjacent winding, and
the conductor includes
an annular base extending in the radial direction of the central axis, and
a pair of extensions individually extended from and contacting opposite ends of the annular base in the radial direction of the central axis of the annular base,
in each of the pair of extensions, at least a surface opposite to a winding in the direction extending along the central axis is rounded, and
each of the pair of extensions projects opposite to the winding relative to the annular base in the direction extending along the central axis.

2. The stationary induction apparatus according to claim 1, wherein an electric field generated at the outer peripheral end of the conductor is smaller than an electric field generated at the outer peripheral end of the electric wire portion of the adjacent winding.

3. The stationary induction apparatus according to claim 1, wherein an electric field generated at the inner peripheral end of the conductor is smaller than an electric field generated at the inner peripheral end of the electric wire portion of the adjacent winding.

4. The stationary induction apparatus according to claim 1, wherein the plurality of windings are concentrically wound around the core.

5. The stationary induction apparatus according to claim 1, wherein the plurality of windings are wound around the core to be coaxially disposed.

6. A stationary induction apparatus comprising:
a core;
a plurality of windings wound around the core that is a central axis; and
a plurality of annular electrostatic shields disposed adjacent to respective ends of the plurality of windings in a direction extending along the central axis,
each of the plurality of windings including
an electric wire portion, and
a first insulating coating that coats the electric wire portion,
each of the plurality of electrostatic shields including
a conductor, and
a second insulating coating that coats the conductor,
the stationary induction apparatus satisfying at least one positional relationship among
a positional relationship in which an outer peripheral end of the conductor in each of the plurality of electrostatic shields is located inside an outer peripheral end of the electric wire portion of an adjacent winding among the plurality of windings, the adjacent winding being adjacent to the electrostatic shield in the direction extending along the central axis, and
a positional relationship in which an inner peripheral end of the conductor in each of the plurality of electrostatic shields is located outside an inner peripheral end of the electric wire portion of the adjacent winding,
the second insulating coating includes
a first insulator disposed on the winding side adjacent to the electrostatic shield, and
a second insulator disposed opposite to the winding adjacent to the electrostatic shield, and
only a surface of the second insulator facing the first insulator is provided with an annular groove corresponding to an outside shape of the conductor.

7. The stationary induction apparatus according to claim 6, wherein an electric field generated at the outer peripheral end of the conductor is smaller than an electric field generated at the outer peripheral end of the electric wire portion of the adjacent winding.

8. The stationary induction apparatus according to claim 6, wherein an electric field generated at the inner peripheral end of the conductor is smaller than an electric field generated at the inner peripheral end of the electric wire portion of the adjacent winding.

9. The stationary induction apparatus according to claim 6, wherein the plurality of windings are concentrically wound around the core.

10. The stationary induction apparatus according to claim 6, wherein the plurality of windings are wound around the core to be coaxially disposed.

* * * * *